United States Patent [19]

Nord et al.

[11] Patent Number: 4,754,772

[45] Date of Patent: Jul. 5, 1988

[54] ARRANGEMENT IN A DISH-WASHING MACHINE

[75] Inventors: Carl-Gustaf H. Nord, Forserum; Per O. E. Eknor; Ragnar B. Berglund, both of Huskvarna, all of Sweden

[73] Assignee: Aktiebolaget Electrolux, Sweden

[21] Appl. No.: 5,627

[22] Filed: Jan. 21, 1987

[30] Foreign Application Priority Data

Jan. 31, 1986 [SE] Sweden ..... 8600446

[51] Int. Cl.[4] ..... B08B 3/02; B08B 13/00

[52] U.S. Cl. ..... 134/111; 210/456

[58] Field of Search ..... 134/111, 109, 110; 210/456, 420; 68/18 F

[56] References Cited

U.S. PATENT DOCUMENTS

| | | | |
|---|---|---|---|
| 2,413,954 | 1/1947 | Conterman | 68/18 F |
| 2,720,771 | 10/1955 | Lewis | 68/18 F |
| 2,894,631 | 7/1959 | Levit et al. | 134/111 |
| 3,322,282 | 5/1967 | Lyman | 134/110 |
| 3,457,929 | 7/1969 | Madden | 134/111 |

*Primary Examiner*—Harvey C. Hornsby
*Assistant Examiner*—J. Dwight Poffenberger, Jr.
*Attorney, Agent, or Firm*—Alfred E. Miller

[57] ABSTRACT

In a dish-washing machine the bottom of the washing chamber has an outlet opening which is covered by a filter arrangement comprising a tubular part of a fine sieve. The tubular part is vertically and centrally disposed in a filter housing and extends through the whole housing. Liquid can pass through the tubular part radially in all directions. The lower part of the filter housing is connected to the suction side of a circulation pump by a conduit connected to the side wall of the housing. Further, a shield is disposed between the tubular part of the fine sieve and the filter housing, the shield having a construction and arrangement whereby the pressure drop across the tubular part of the fine sieve will become essentially evenly distributed around its periphery.

6 Claims, 3 Drawing Sheets

ARRANGEMENT IN A DISH-WASHING MACHINE

The present invention relates to a filter outlet arrangement in a dish-washing machine.

In a prior art dish-washing machine the bottom of the washing chamber has an outlet opening which is covered by a filter arrangement comprising a coarse sieve and a fine sieve. The coarse sieve is funnel-shaped and is placed in a tubular part of the fine sieve. The coarse sieve and the part of the fine sieve are vertically disposed in a filter housing. To the lower part of the housing a conduit connects which interconnects the housing with the suction side of a circulation pump supplying the washing chamber with pressurized liquid.

In the known machine it has appeared that the portion of the tubular part of the fine sieve situated just in front of the outlet to the circulation pump tends to become clogged by released food scraps in the circulating liquid due to a higher drop of pressure across this portion of the fine sieve caused by the suction from the circulation pump. The clogging spreads and if the fine sieve is not regularly cleaned the clogging of the tubular fine sieve can become total. As a result the flushing pressure in the washing chamber is reduced and the cleaning effect will greatly deteriorate.

The increased pressure drop across part of the fine sieve results in that the contaminations adhere to the meshes of the sieve and become difficult to remove. As a result the operation of the drain pump will be also be affected. The suction force of this pump is considerably less than that of the circulation pump and this force is not capable of effectively eliminating the contamination adhering to the fine sieve. As a result of the reduced flow, the draining requires more time which counteracts the shortening of the treatment times commonly aimed at.

For the purpose of remedying the drawbacks indicated above and providing an arrangement wherein the pressure drop across the tubular part of the fine sieve is essentially equal in all points, DE-27 57 616 proposes a shield to be disposed in the area between the inlet to the circulation pump and the part of the fine sieve situated just in front of the said inlet. A filter housing surrounding the fine sieve has a circular shape and the shield extends only along the part of the annular area between the fine sieve and the filter housing which connects to the circulation pump. The shield has a part extending slantingly downwards towards the bottom of the filter housing, said part together with said bottom forming an aperture 13. The principal drawback with this proposed arrangement is that the shield operates only along part of the filter surface of the tubular part of the fine sieve. Due to this and to the fact that the aperture has the same cross-section in all points the desirable even distribution of the liquid through the fine sieve cannot be fully achieved causing a remaining risk of clogging.

The invention has for its object an arrangement of the kind indicated above to provide an even more efficient distribution of the liquid flow through the filter system so as to almost completely eliminate the risk of clogging.

An embodiment of the invention will now be described with reference to the enclosed drawing.

In the drawings

FIG. 1 schematically shows a dish-washing machine.

Figure 1:
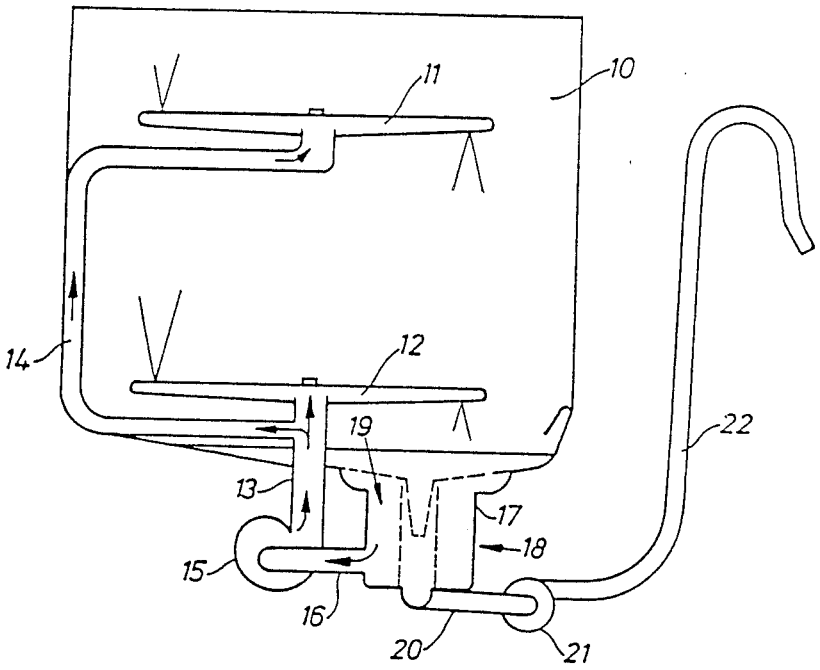
Fig. 1 (PRIOR ART)

A known dish-washing machine is schematically disclosed in FIG. 1. The machine has a washing chamber 10 in which two spray arms 11, 12 are rotatably disposed to apply jets of cleaning liquid onto dish goods supported in the washing chamber by baskets, not shown. Liquid is supplied to the spray arms via conduits 13, 14 which are connected to the pressure side of a circulation pump 15. The suction side of the pump is via a conduit 16 connected to a filter housing 17 being part of a filter arrangement 18 effecting the separation of released food scraps from the cleaning liquid. Further, the filter housing is connected to an outlet opening 19 disposed in the bottom of the washing chamber. At the bottom of the filter housing a conduit 20 connected which leads to a drain pump 21 by which used liquid is being pumped away from the machine via a hose 22.

Figure 2:
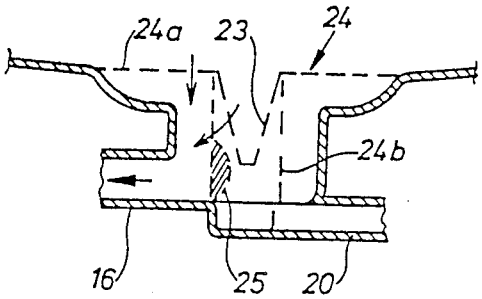
Fig. 2 (PRIOR ART)
FIG. 2 is a detail view of the bottom part of the machine with connecting prior art filter arrangement.

FIG. 2 shows a known filter arrangement comprising a coarse sieve 23 and a fine sieve 24. The fine sieve has a part **24*a* which is mainly horizontal and in the central part of which tubular part 24*b* connects. The part 24*b* extends vertically to the bottom of the filter housing and opens just in front of the drain conduit 20**.

When the machine operates, liquid collected on the bottom of the washing chamber will pass the horizontal part **24*a* of the fine sieve and flow down in the annular space which surrounds the tubular part 24*b* of the fine sieve as well as into the tubular part of the fine sieve via the coarse sieve. The liquid will pass the tubular part of the fine sieve radially outwards in all directions. However, the suction force exerted by the circulation pump will cause a greater pressure drop across the part 24*b* of the fine sieve in the area just in front of the opening of the conduit 16 than across the remaining part of the fine sieve. As a result the accumulation of released food scraps in this area will increase and in addition these contaminations, as shown by the hatched area 25**, will tend to stick fast in the meshes of the sieve so as to become difficult to remove. As already indicated by way of introduction the clogging of the fine sieve will cause reduction of the flushing pressure leading to a reduced cleaning effect.

Figure 3:
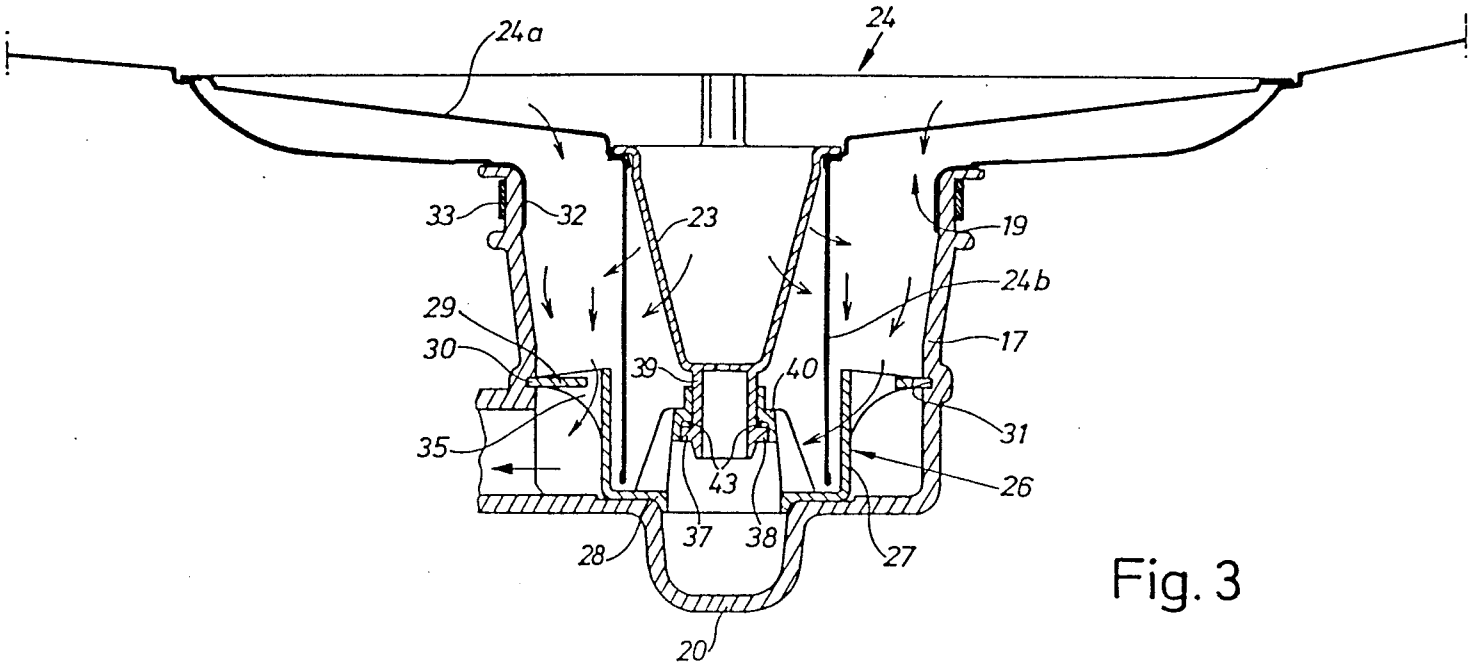
FIG. 3 shows the embodiment of FIG. 2 modified according to the invention and including a pressure equalizing shield. Finally.

FIG. 3 shows an embodiment in which the filter arrangement has been modified according to the invention in order to prevent the clogging of the tubular part of the fine sieve. Parts already mentioned with reference to FIGS. 1 and 2 will be referred to in FIGS. 3 and 4 by use of the same reference characters.

In accordance with the invention the most important part of the arrangement is a shield 26 which directs the liquid such that the pressure drop across the tubular part **24*b* of the fine sieve will be essentially evenly distributed around the periphery of the sieve. To this end the shield has a tubular part 27 which coaxially surrounds the tubular part 24*b* of the fine sieve. The part 27 has an annular bottom portion 28 which sealingly engages with the bottom of the filter housing. The tubular part 27 extends vertically upwards to a height exceeding the height of the conduit 16. Moreover, the shield has a horizontal part 29 the outer circular edge 30 of which is inserted into a groove 31 in the side wall of the filter housing. The fitting in of the edge 30 in the groove 31 is facilitated by the filter housing being made of rubber and thereby being elastic or flexible. The filter housing is pushed into a flange surrounding the outlet opening 19 in the bottom of the washing chamber and is secured to it by a hose clip 33**.

Figure 4:
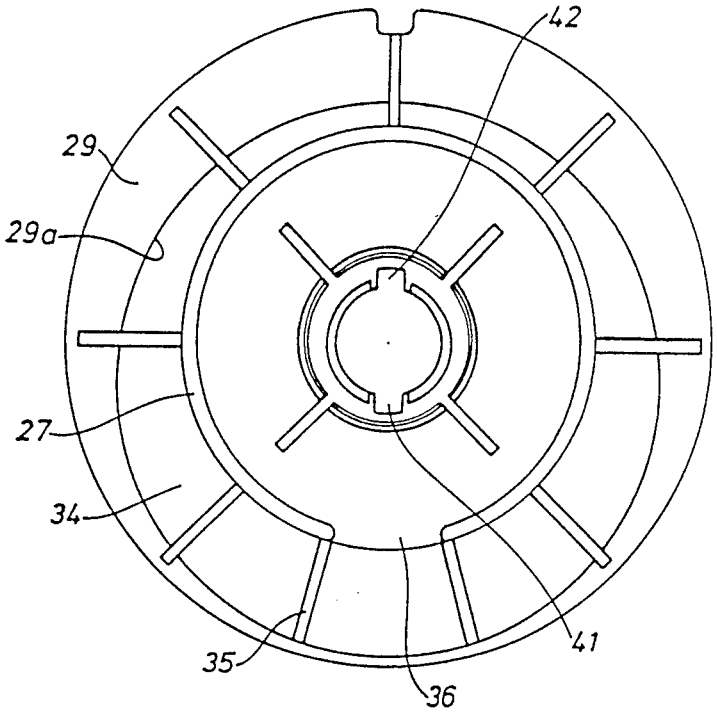
FIG. 4 is a detail view of the shield of FIG. 3 as shown from above.

As best shown in FIG. 4 the horizontal part 29 of the shield has an annular opening 34 which has a varying width around the periphery. The opening has its smallest width at the side facing the opening of the conduit 16 in the filter housing. The opening has its greatest width at the diametrically opposite side. The width of the opening varies between the greatest and the smallest value such that the suction force caused by the circulation pump 15 is evenly distributed around the periphery of the tubular part **24*b* of the fine sieve. In the example shown this takes place in that the opening is bounded by the periphery of the tubular shield part 27 and an edge 29*a* of the horizontal shield part 29**, the said edge coinciding with a circle which is eccentric relative to the tubular shield part.

The two shield parts 27 and 29 are interconnected by a number of laths or supports 35 which extend radially outwards from the tubular shield part 27. Further, the part 27 has a vertical slot 36 admitting the draining of liquid also from the central parts of the filter housing after the termination of a washing operation.

As shown in FIG. 3 the coarse sieve 23 is inserted in the tubular part **24*b* of the fine sieve. At its lower end the coarse sieve has a tubular part 39 which is provided with projections 37, 38. The part 39 is inserted in a centrally disposed sleeve-shaped part 40 of the shield 26. The part 40 has recesses 41, 42 which correspond to the projections 37, 38 and, further, the part 40 has cam surfaces 43 which cooperate with the projections 37, 38 to form a bayonet attachment for the coarse sieve 23**.

In the device shown in FIGS. 3 and 4 liquid entering the tubular part **24*b* of the fine sieve will be stopped from directly reading the opening of the conduit 16 by the shield part 27. Instead, the liquid stream is forced upwards and has to pass the annular opening 34 before reading the annular space between the shield part 27 and the filter housing 17 to which the conduit 16 connects. Following the variation of the width of the opening in the way indicated also the flow through the opening will vary and the pressure drop across the part 24*b*** of the fine sieve will be evenly distributed around its periphery.

We claim:

1. In a dishwashing machine having a washing chamber in which pressurized liquid is projected on to dishes or the like, a liquid circulation pump for generating said liquid, an outlet opening in the bottom of said washing chamber and connected to said circulation pump, a drain pump for pumping away the waste liquid in said washing chamber, a filter arrangement in the path of said outlet opening including a filter housing having side and bottom walls and a fine sieve having a tubular part being positioned substantially centrally in said filter housing and through which liquid can pass radially in all directions, the lower part of the filter housing being connected to the suction side of the circulation pump by means of a conduit connected into the side wall of said filter housing, the improvement comprising a shield being located in said filter housing between the latter and said tubular part of the fine sieve, said shield being so constructed and arranged that the pressure drop across said tubular part of the fine sieve is evenly distributed around its periphery, said shield being tube-shaped and co-axially surrounding said tubular part of the fine sieve and at its upper part is provided with a radially disposed annular section the periphery of which is connected to the interior of said filter housing, and an annular opening in the annular section of said shield wherein the width of said annular opening continuously increases from a minimum value at the side of said filter housing to which said conduit to the circulation pump is connected to a maximum value at the diametrically opposite side of said filter housing.

2. The arrangement as claimed in claim 1 wherein said annular opening is bounded by the outer peripheral surface of the tubular part of the shield and an internal edge of said annular section, said edge coinciding with a circle that is eccentrically located with respect to said tubular part.

3. The arrangement as claimed in claim 2 wherein said tubular part of said shield extends vertically from the bottom of said filter housing to a height which exceeds the vertical height of of said conduit connected to the circulation pump.

4. The arrangement as claimed in claim 1 wherein said drain pump is connected to the bottom of said filter housing in a central area in front of said tubular part of the fine sieve, and further comprising a funnel-shaped coarse sieve inserted within said tubular part, and said coarse sieve being removably secured to said shield.

5. The arrangement as claimed in claim 4 wherein said coarse sieve and shield are provided with attachment parts forming a bayonet type lock joint.

6. The arrangement as claimed in claim 1 wherein said filter housing is is provided with a groove and is fabricated of a flexible material, and said periphery of said annular section of the shield is inserted in said groove.

* * * * *